US006404406B2

(12) United States Patent
Dellantoni et al.

(10) Patent No.: US 6,404,406 B2
(45) Date of Patent: Jun. 11, 2002

(54) ANTENNA HAVING A WIDE BANDWIDTH

(75) Inventors: Nikolaus Dellantoni, Baden/Sooss; Peter-Ernst Veith, Vienna, both of (AT)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/778,534

(22) Filed: Feb. 7, 2001

Related U.S. Application Data

(63) Continuation of application No. PCT/DE99/02403, filed on Aug. 2, 1999.

(30) Foreign Application Priority Data

Aug. 7, 1998 (DE) ..... 198 35 878

(51) Int. Cl.[7] ..... H01Q 1/36
(52) U.S. Cl. ..... 343/895; 343/846
(58) Field of Search ..... 343/895, 867, 343/829, 846, 702, 737, 742, 770, 776, 810, 826, 853; H01Q 1/36

(56) References Cited

U.S. PATENT DOCUMENTS

| | | | | | |
|---|---|---|---|---|---|
| 2,583,745 | A | | 1/1952 | Miller | 250/33 |
| 5,041,842 | A | * | 8/1991 | Blaese | 343/882 |
| 5,343,214 | A | * | 8/1994 | Hadzoglou | 343/713 |
| 5,345,248 | A | * | 9/1994 | Hwang et al. | 343/895 |
| 5,457,469 | A | | 10/1995 | Diamond et al. | 343/730 |
| 5,477,232 | A | * | 12/1995 | Yamamoto | 343/713 |
| 5,714,959 | A | * | 2/1998 | Troy et al. | 343/713 |
| 6,147,661 | A | * | 11/2000 | Nakagawa et al. | 343/895 |
| 6,181,286 | B1 | * | 1/2001 | Roscoe et al. | 343/725 |
| 6,215,451 | B1 | * | 4/2001 | Hadzoglou | 343/715 |
| 6,243,052 | B1 | * | 6/2001 | Goldstein et al. | 343/895 |

FOREIGN PATENT DOCUMENTS

| | | |
|---|---|---|
| AT | 243342 | 11/1965 |
| DE | 42 04 084 | 9/1993 |
| DE | 196 39 642 A1 | 4/1997 |
| DE | 196 14 362 C1 | 7/1997 |
| GB | 2 050 701 A | 1/1981 |

OTHER PUBLICATIONS

Published International Application No. WO 98/18178 (Knowles et al.), dated Apr. 30, 1998.

Japanese Patent Abstract No. 4–86104 (A) (Kono), dated Mar. 18, 1992.

"Dual Frequency Helical Antennas for Handsets" (Haapala et al.), Helsinki University of Technology, dated Apr. 28, 1996, pp. 336–338, as mentioned on page 2 of the specification.

"A Quadhelix Antenna for the 1215–Mc.Band" (Trötschel), dated 1963, High Gain and Simple Matching, pp. 36–38.

* cited by examiner

*Primary Examiner*—Don Wong
*Assistant Examiner*—Trinh Vo Dinh
(74) *Attorney, Agent, or Firm*—Laurence A. Greenberg; Werner H. Stemer; Gregory L. Mayback

(57) ABSTRACT

An antenna includes antenna elements for transmitting and receiving signals. The antenna elements have a helical shape and are disposed parallel to one another. The antenna elements are individually connected in parallel to a common conductor surface and are capacitively coupled to a radio-frequency counterpoise via the common conductor surface.

5 Claims, 3 Drawing Sheets

CH1 S11 SWR 1 / REF 1

Cor
MARKER 1
880 MHz
1: 2.0475
880.000 000 MHz
2: 2.3713
960 MHz
A
B
C
f02
f01
fe1
fe2
f03
fe3
CENTER 920 .000 000 MHz
SPAN 500.000 000 MHz

CH1 S11 log MAG 10 dB/ REF 0 dB

Cor
MARKER 1
879 . 15 MHz
1: 18.111
879.000 000 MHz
2: -18.501 dB
960 MHz
CENTER 920 .000 000 MHz
SPAN 500.000 000 MHz

ANTENNA HAVING A WIDE BANDWIDTH

CROSS-REFERENCE TO RELATED APPLICATION

This application is a continuation of copending International Application No. PCT/DE99/02403, filed Aug. 2, 1999, which designated the United States.

BACKGROUND OF THE INVENTION

FIELD OF THE INVENTION

The invention relates to an antenna for transmitting and receiving signals.

Helical antenna elements for antennas for telecommunications devices are known, for example from Published, Non-Prosecuted German Patent Application DE 196 39 642 A1, which discloses a retractable antenna device having a helical antenna section.

Published, Non-Prosecuted German Patent Application DE 42 05 084 A1 discloses a pair of conductor structures for receiving electromagnetic waves, in which each element of the pair is constructed to form an overall structure including individual elements. The individual elements are connected to one another in series and are stacked in planes one above the other. Each pair of individual elements in each plane is configured such that the turns of the spiral run in opposite directions to one another. The individual elements in each plane are in the form of spiral, planar structures. The above-mentioned documents do not deal with any measures to reduce the possibility of the antennas being slightly mistuned by capacitive influences from the environment or to increase the bandwidth of the antennas in comparison to an individual antenna.

One possible way to reduce capacitive influences with the aid of a radio-frequency counterpoise is described in the document by Haapala P. et al., "Dual Frequency Helical Antennas for Handsets", IEEE Vehicular Technology Conference, US, New York, IEEE, Conf. Proc. 46, pages 336–338, XP000594306, in which case the radio-frequency counterpoise results in an increase in the base impedance of the antenna. This document also describes a parallel circuit formed by two antenna elements having helical sections but, in this case, the bandwidth of one of the two antenna elements is reduced in comparison to that of a single antenna.

SUMMARY OF THE INVENTION

It is accordingly an object of the invention to provide an antenna for transmitting and receiving signals which overcomes the above-mentioned disadvantages of the heretofore-known antennas of this general type and which allows a wider bandwidth and better matching to a radio-frequency counterpoise and to a feed line system.

With the foregoing and other objects in view there is provided, in accordance with the invention, an antenna for transmitting and receiving signals, including at least a first antenna element and a second antenna element for transmitting and/or receiving signals of a same frequency;

the at least first and second antenna elements having a helical shape and being disposed parallel to one another;

a common conductor surface, the at least first and second antenna elements being individually connected in parallel to the common conductor surface; and a radio-frequency counterpoise, the at least first and second antenna elements being capacitively coupled to the radio-frequency counterpoise via the common conductor surface.

In other words, the object of the invention is achieved by an antenna for transmitting and receiving signals having at least a first and a second antenna element for transmitting and receiving signals at the same frequency, with the antenna elements having a helical or spiral shape, being provided parallel to one another, in each case being connected individually to a common conductor surface and connected in parallel, and being capacitively coupled to a radio-frequency counterpoise via the conductor surface.

Due to their compact structure, such antennas can be used as internal antennas in telecommunications apparatuses, such as cordless telephones.

The two or more antenna elements which are provided parallel result in a wider bandwidth, as a consequence of which the antenna according to the invention is less sensitive to capacitive influences from the environment. Furthermore, higher currents which are induced at the base point or feed point of the antenna and are better distributed over a large area allow the two or more antenna elements to be better matched to the radio-frequency counterpoise and to the feed line system.

The antenna elements are preferably coupled to the radio-frequency counterpoise through the use of a capacitive coupling element. The capacitive coupling element may in this case include conductor surfaces which are printed on opposite sides of the radio-frequency counterpoise.

According to another feature of the invention, the at least first and second antenna elements are coupled to the radio-frequency counterpoise with a capacitive coupling element.

According to yet another feature of the invention, the radio-frequency counterpoise has opposite sides and the capacitive coupling element is a printed structure provided on the opposite sides.

According to a further feature of the invention, the at least first and second antenna elements include helical coils.

Other features which are considered as characteristic for the invention are set forth in the appended claims.

Although the invention is illustrated and described herein as embodied in an antenna having a wide bandwidth, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
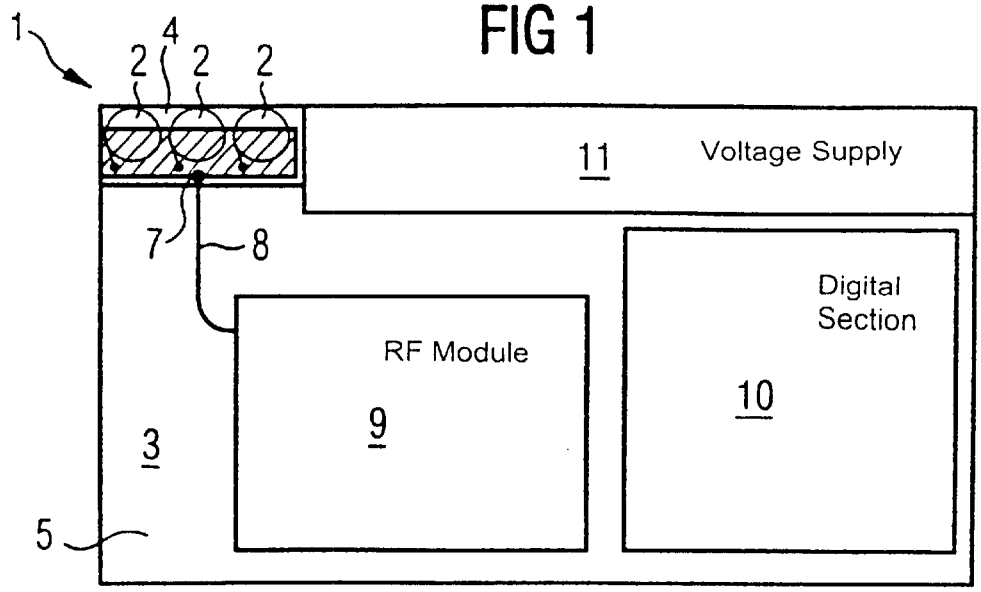
FIG. 1 is a schematic plan view of an antenna according to the invention.

Referring now to the figures of the drawings in detail and first, particularly, to FIG. 1 thereof, there is shown a plan view of a preferred exemplary embodiment of an antenna 1 according to the invention which has three helical antenna elements 2 which are disposed in parallel. The antenna elements 2 are coupled to a radio-frequency counterpoise 3, which may be formed of a rectangular conductor surface or of a dielectric which is printed with printed circuit boards or conductor surfaces.

Figure 2:
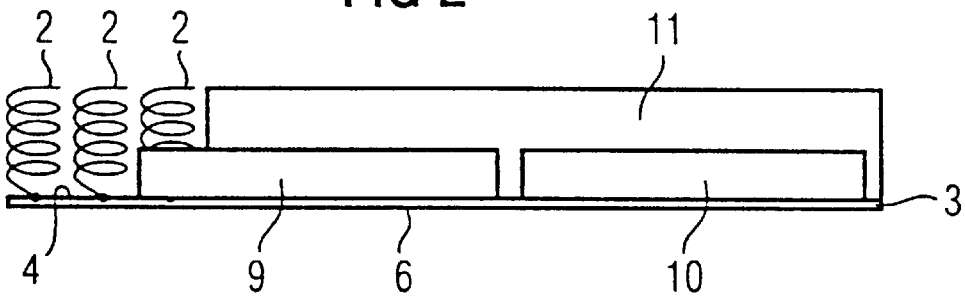
FIG. 2 is a schematic side view of the antenna shown in FIG. 1 according to the invention.

The antenna elements 2 include wound antenna elements preferably metal helical coils whose center axes are provided parallel to one another and horizontally or vertically with respect to the plane of the radio-frequency counterpoise, as can be seen in FIGS. 1 and 2. The three antenna elements 2 are connected to a first conductor surface 4, which is printed on the radio-frequency counterpoise 3. The first conductor surface 4 is printed at a corner on a side surface of the radio-frequency counterpoise. The first conductor surface 4 is connected via a feed point 7 to a feed line 8, which supplies signals received via the antenna elements 2 to a radio-frequency module 9, and supplies signals to be transmitted to the antenna elements 2 from the radio-frequency module 9.

A second conductor surface 5 is also printed on the same side of the radio-frequency counterpoise 3 on which the first conductor surface 4 is printed. This second conductor surface 5 is isolated from the first conductor surface 4. The radio-frequency module 9, a digital section 10 connected to the radio-frequency module 9 and a voltage supply 11 for the digital section 10 and the radio-frequency module 9 are located on the second conductor surface 5.

A third conductor surface 6 is printed on the radio-frequency counterpoise opposite the two conductor surfaces 4 and 5. The third conductor surface 6 has a size corresponding approximately to the size of the conductor surface 5 and is not located underneath the conductor surface 4, so that this results in a capacitive coupling element formed of the conductor surface 4, for coupling the antenna elements 2 to the radio-frequency counterpoise. The three antenna elements 2 are connected in parallel, that is to say they are each connected individually to the first conductor surface 4 and are connected via a common feed point 7 on the first conductor surface 4 to the radio-frequency module 9.

The higher currents which are induced at the base of the antenna, that is to say in the first conductor surface 4, and which are better distributed over a large area allow the antenna elements 2 to be matched very well to the radio-frequency counterpoise 3 and to the impedance of the feed line 8, the impedance being approximately 50 Ohms. The use of three parallel antenna elements 2 allows to achieve a wide useful bandwidth.

Figure 3:
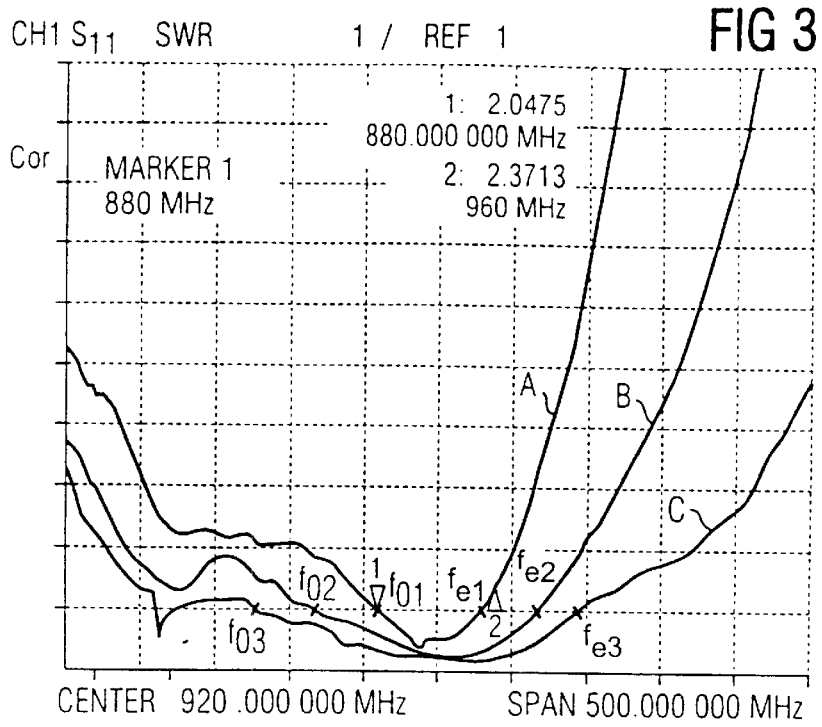
FIG. 3 is a graph illustrating a standing-wave ratio for an antenna having one, two or three antenna elements.

FIG. 3 shows the standing-wave ratio SWR for an antenna having one, two and three helical antenna elements 2 in the frequency band between 880 and 960 MHz (mid-frequency 920 MHz). The first curve A shows the standing-wave ratio for an antenna having one antenna element, the second curve B shows the standing-wave ratio for an antenna having two antenna elements, and the third curve C shows the standing-wave ratio for an antenna having three antenna elements. In this case, the points annotated $f_{01}$, $f_{02}$, $f_{03}$ indicate the respective start of the useful band, and the points annotated $f_{e1}$, $f_{e2}$ and $f_{e3}$ indicate the respective end of the useful band. The curve C in this case shows the standing-wave ratio of an antenna whose construction corresponds to that of the antenna 1 in FIG. 1 and in FIG. 2. The curve B has essentially the same form, but only two parallel helical antenna elements 2 are provided. The antenna corresponding to curve A has only one helical antenna element.

As can be seen from FIG. 3, the bandwidth of the antenna with one helical element is approximately 6.2% (curve A), the bandwidth of an antenna having two antenna elements is approximately 16% (curve B), and the bandwidth of an antenna having three antenna elements is approximately 24% (curve C). The use of a number of parallel, helical antenna elements thus considerably increases the useful bandwidth.

Figure 4:
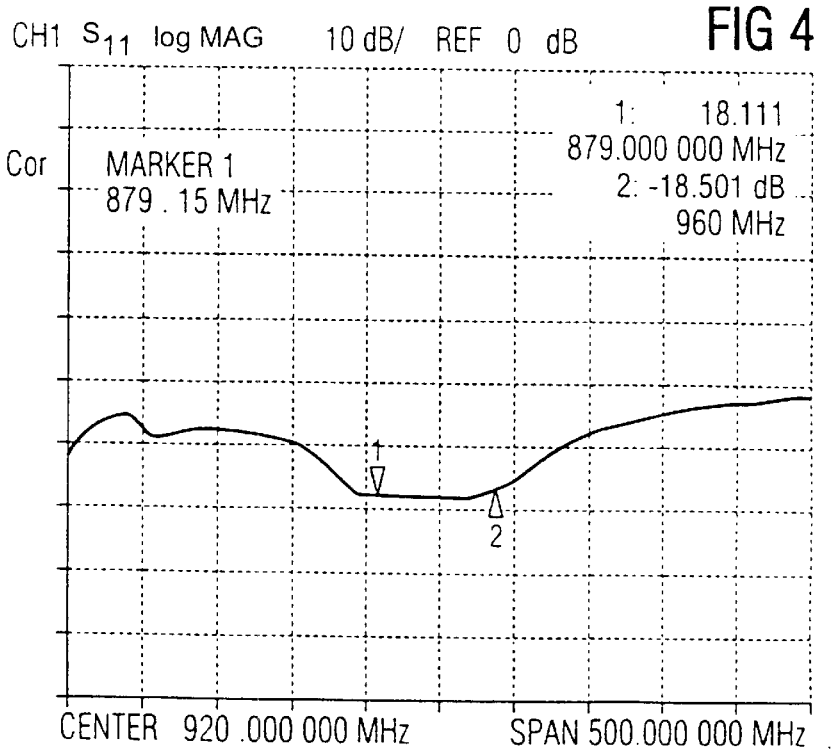
FIG. 4 is a graph illustrating the return loss of the antenna shown in FIGS. 1 and 2.
Figure 5:
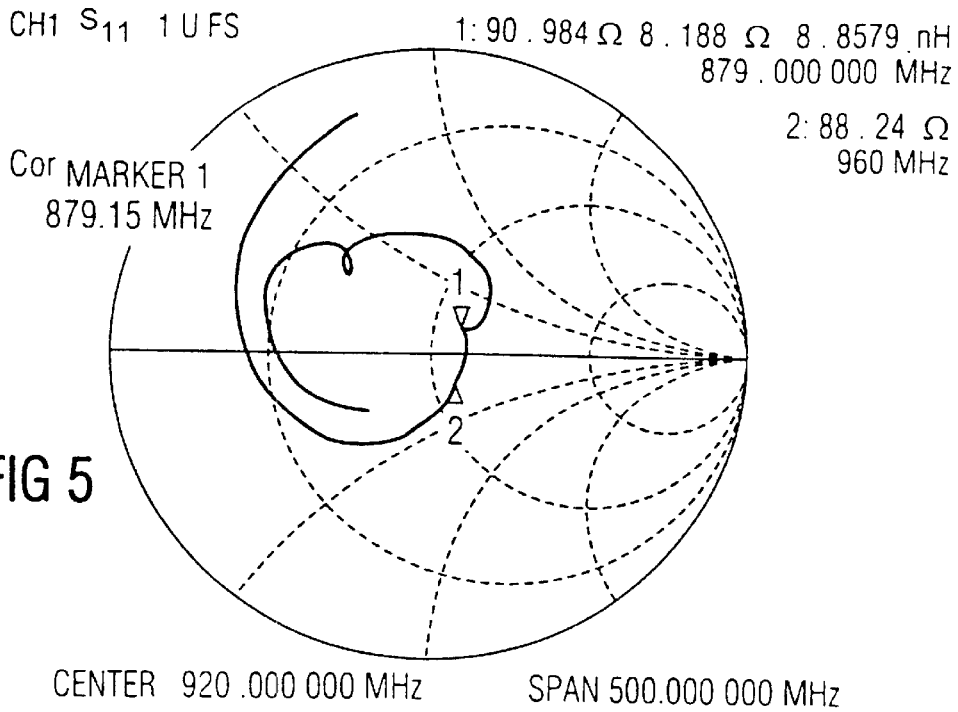
FIG. 5 is a graph illustrating the base impedance of the antenna shown in FIGS. 1 and 2.
Figure 6:
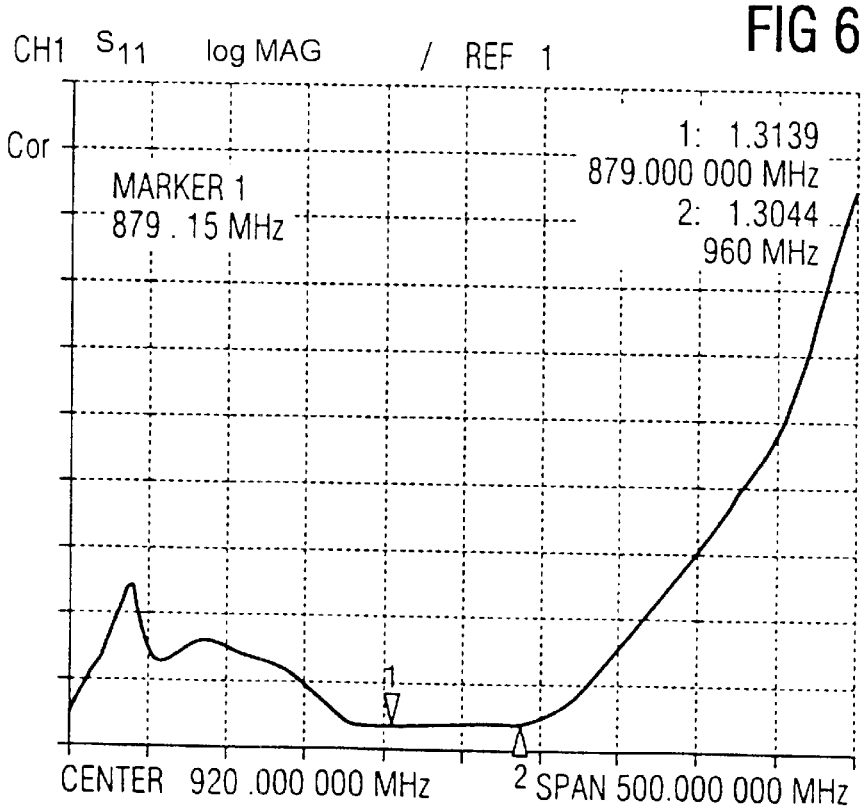
FIG. 6 is a graph illustrating the standing-wave ratio of the antenna shown in FIGS. 1 and 2.

FIGS. 4, 5 and 6 respectively show the return loss, the base impedance and the standing-wave ratio of the antenna configuration shown in FIGS. 1 and 2 in the frequency band between 880 MHz and 960 MHz (mid-frequency 920 MHz). As can be seen, the 3 dB useful bandwidth is between approximately 820 and 995 MHz. The return loss and standing-wave ratio $S_{11}$ respectively are illustrated in a logarithmic scale (log MAG).

The base impedance in the signal band is approximately (60+ix9) Ohms and 880 MHz and (58−ix13) Ohms at 960 MHz. The standing-wave ratio is approximately 1:1.3 at 880 MHz and 1:1.4 at 960 MHz. The antenna according to the invention is thus universally suitable for mobile and compact stationary cordless terminals, base stations and relay stations for the various telecommunications standards in frequency bands up to 3 GHz.

We claim:

1. An antenna for transmitting and receiving signals, comprising:

at least a first antenna element and a second antenna element for at least one of transmitting and receiving signals of a same frequency;

said at least first and second antenna elements having a helical shape and being disposed parallel to one another;

a common conductor surface, said at least first and second antenna elements being individually connected in parallel to said common conductor surface; and a radio-frequency counterpoise, said at least first and second antenna elements being capacitively coupled to said radio-frequency counterpoise via said common conductor surface.

2. The antenna according to claim 1, wherein said at least first and second antenna elements are coupled to said radio-frequency counterpoise with a capacitive coupling element.

3. The antenna according to claim 2, wherein said radio-frequency counterpoise has opposite sides and said capacitive coupling element is a printed structure provided on at least one of said opposite sides.

4. The antenna according to claim 1, wherein said at least first and second antenna elements include helical coils.

5. The antenna according to claim 1, wherein said first antenna element and said second antenna element are disposed relative to each other to broaden a combined bandwidth.

* * * * *